US008500485B2

(12) United States Patent
Fu et al.

(10) Patent No.: US 8,500,485 B2
(45) Date of Patent: Aug. 6, 2013

(54) FIXING APPARATUS FOR CONNECTOR

(75) Inventors: Li-Ren Fu, Shenzhen (CN); Jun-Hui Wang, Shenzhen (CN); Ai-Ling He, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 30 days.

(21) Appl. No.: 13/367,336

(22) Filed: Feb. 6, 2012

(65) Prior Publication Data

US 2013/0065432 A1 Mar. 14, 2013

(30) Foreign Application Priority Data

Sep. 9, 2011 (CN) ..... 2011 1 0267027

(51) Int. Cl.
*H01R 13/73* (2006.01)

(52) U.S. Cl.
USPC ..... 439/545

(58) Field of Classification Search
USPC ..... 439/545, 548, 549, 248
See application file for complete search history.

(56) References Cited

U.S. PATENT DOCUMENTS

| | | | | |
|---|---|---|---|---|
| 3,425,025 | A * | 1/1969 | Williams | 439/347 |
| 4,411,485 | A * | 10/1983 | Wiseheart et al. | 439/343 |
| 4,810,204 | A * | 3/1989 | Wilson | 439/343 |
| 4,822,296 | A * | 4/1989 | Wilson | 439/343 |
| 5,157,590 | A * | 10/1992 | Barthel et al. | 361/825 |
| 5,320,554 | A * | 6/1994 | Freer et al. | 439/347 |
| 5,402,487 | A * | 3/1995 | Swett | 379/435 |
| 6,695,629 | B1 * | 2/2004 | Mayer | 439/92 |
| 7,384,283 | B2 * | 6/2008 | Lin | 439/157 |
| 7,858,886 | B2 * | 12/2010 | Helms et al. | 174/535 |

* cited by examiner

*Primary Examiner* — Phuong Dinh
(74) *Attorney, Agent, or Firm* — Altis Law Group, Inc.

(57) ABSTRACT

A fixing apparatus for fixing a connector includes a protrusion, a fixing plate, and a fastener. The protrusion protrudes from the connector, and is located at a side of the connecting portion. The protrusion includes a head portion and a pin connected between the head portion and the connector. The fixing plate defines an opening, a first hole, a second hole communicating with the first hole, and a positioning hole. The fastener is fixed to the connector and includes an extendable shaft. When the connecting portion extends through the opening, the protrusion extends through the first hole, and the shaft abuts against the fixing plate. The connector is moved to allow the pin to enter the second hole. The head portion is blocked by the fixing plate. The shaft engages in the positioning hole.

12 Claims, 4 Drawing Sheets

FIXING APPARATUS FOR CONNECTOR

BACKGROUND

1. Technical Field

The present disclosure relates to an apparatus for fixing a connector.

2. Description of Related Art

Connectors, such as serial advanced technology attachment (SATA) connectors, may be mounted with screws to a sidewall of an enclosure of an electronic device. However, such screws are usually small and difficult to handle, and the installation of the connectors in the computer is tedious.

BRIEF DESCRIPTION OF THE DRAWINGS

Many aspects of the present embodiments can be better understood with reference to the drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
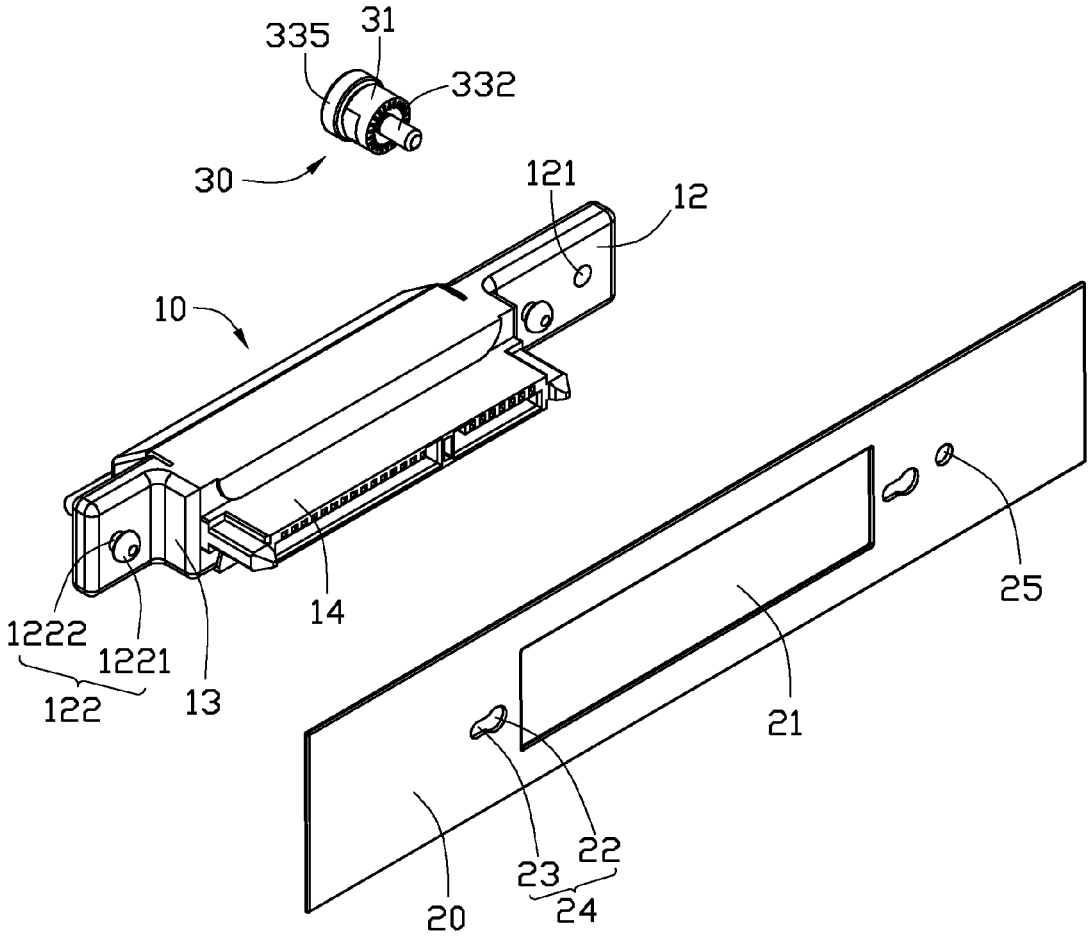
FIG. 1 is an exploded, isometric view of an exemplary embodiment of a fixing apparatus together with a connector, wherein the fixing apparatus includes a fastener.
Figure 2:
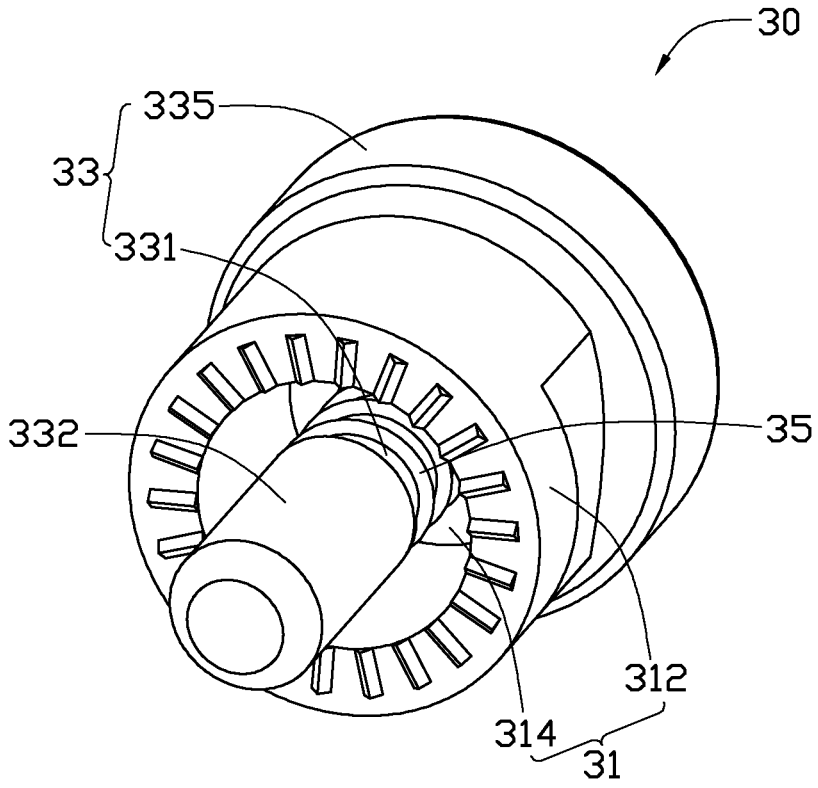
FIG. 2 is an enlarged view of the fastener of FIG. 1, but viewed from another perspective.
Figure 4:
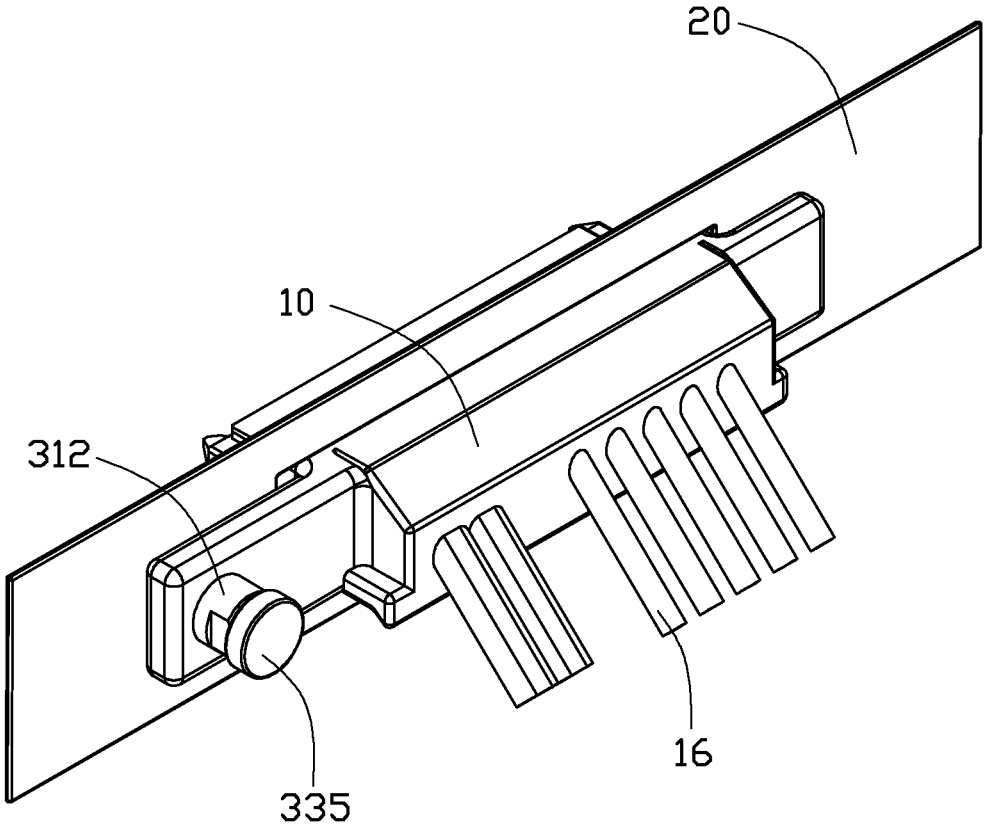
FIG. 4 is similar to FIG. 3, but viewed from another perspective.

Referring to FIGS. 1, 2 and 4, an exemplary embodiment of a fixing apparatus is provided to fix a connector 10. The fixing apparatus includes a fixing plate 20 and a fastener 30.

The connector 10 includes a substantially rectangular main body 12, a block 13 protruding from the front surface of the main body 12, a connecting portion 14 protruding from the front side surface of the block 13, and a plurality of cables 16 electrically connected to the connecting portion 14 and extending through the rear side surface of the main body 12. Two protrusions 122 protrude from opposite ends of the front side surface of the main body 12, at either side of the block 13. Each protrusion 122 includes a pin 1222 extending from the main body 12 and a tapered head portion 1221 formed on the distal end of the pin 1222. The diameter of the underside of the head portion 1221 adjoining the pin 1222 is larger than the diameter of the pin 1222. A through hole 121 is defined in the main body 12, beside one of the protrusions 122.

The fixing plate 20 is a part of a sidewall of an electronic device enclosure. A substantially rectangular opening 21 is defined in the fixing plate 20. Two holes 24 are defined in the fixing plate 20, flanking the opening 21. Each hole 24 includes a large first hole 22 and a smaller second hole 23 communicating with the first hole 22. A positioning hole 25 is defined in the fixing plate 20 adjacent to one of the holes 24.

The fastener 30 includes a mounting member 31, a latching member 33 slidably connected to the mounting member 31, and a resilient member 35. In the embodiment, the resilient member 35 is a compression spring. The mounting member 31 includes a substantially cylindrical sleeve 312, and an annular end wall 314 radially extending in from the rear end of the sleeve 312. The latching member 33 includes an operation portion 335, and a shaft 331 extending from a side surface of the operation portion 335. The shaft 331 includes a latching portion 332 formed on a distal end of the shaft 331 opposite to the operation portion 335. A diameter of the latching portion 332 is greater than a diameter of the shaft 331. The sleeve 312 and the end wall 314 fit about the shaft 331, with the end wall 314 adjacent to the operation portion 335. The resilient member 35 fits about the shaft 331, between the end wall 314 and the latching portion 332.

The distal end of the sleeve 312 opposite to the end wall 314 is fixed to the rear side of the main body 12, with the latching portion 332 aligning with the through hole 121. In an unfitted state, the distal end of the latching portion 332 extends through the through hole 121 and is exposed out of the front side surface of the main body 12 under a resilient force of the resilient member 35. In the embodiment, the main body 12 is made of plastic, and the sleeve 312 is made of metal. The sleeve 312 is fixed to the rear side surface of the main body 12 by a hot-melting process. In other embodiments, the sleeve 312 may be fixed to the main body 12 by screwthreads or by riveting.

Figure 3:
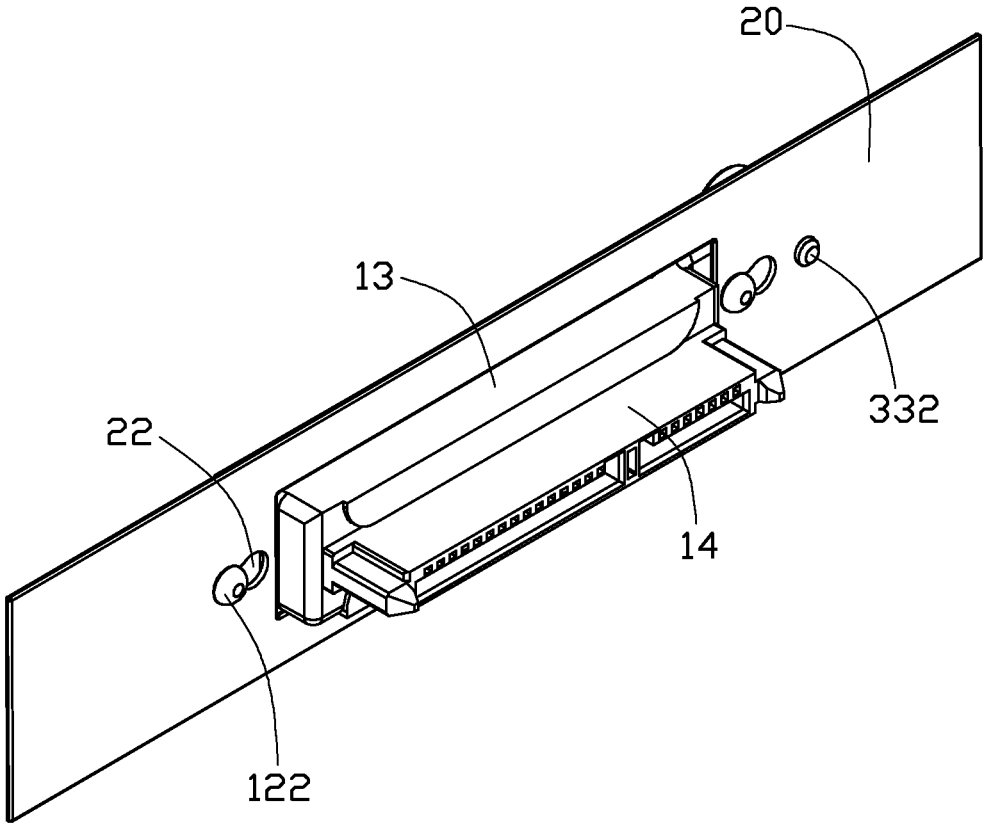
FIG. 3 is an assembled, isometric view of the fixing apparatus and connector of FIG. 1.

Referring to FIGS. 3 and 4, in assembly, the connector 10 is attached to the fixing plate 20. The connecting portion 14 and the block 13 extend through the opening 21. The head portions 1221 and the pins 1222 are manipulated through the corresponding first holes 22. The latching portion 332 resiliently abutts against the fixing plate 20. The main body 12 abuts against the fixing plate 20. The connector 10 is pushed sideways in a first direction, to engage the pins 1222 in the second holes 23. The head portions 1221 are blocked by the fixing plate 20. The latching portion 332 is then aligned with the positioning hole 25. The resilient member 35 self-restores, to allow the latching portion 332 to engage in the positioning hole 25. In this way, the connector 10 is fixed to the fixing plate 20.

To detach the connector 10 from the fixing plate 20, the operation portion 335 is pulled backwards, to allow the latching portion 332 to disengage from the positioning hole 25. The connector 10 is pushed sideways, in a direction opposite to that of the first direction, to bring the protrusions 122 into the first holes 22. When the pins 1222 enter the corresponding first holes 22, the connector 10 can be detached from the fixing plate 20.

Even though numerous characteristics and advantages of the embodiments have been set forth in the foregoing description, together with details of the structure and the functions of the embodiments, the disclosure is illustrative only, and changes may be made in details, especially in the matters of shape, size, and arrangement of parts within the principles of the embodiments to the full extent indicated by the broad general meaning of the terms in which the appended claims are expressed.

What is claimed is:

1. A fixing apparatus for a connector with a connecting portion, the fixing apparatus comprising:

a protrusion comprising a pin extending from the connector and located at a side of the connecting portion, and a large head portion formed at a distal end of the pin;

a fixing plate defining an opening, a hole adjacent to a first end of the opening, and a positioning hole adjacent to the opening, the hole comprising a large first hole and a smaller second hole communicating with the first hole; and a fastener fixed to the connector, the fastener comprising a shaft extending out in a direction perpendicular to the fixing plate;

wherein, when the pin aligns with and extends through the first hole, the connecting portion extends through the opening, and the shaft abuts against the fixing plate; and when the connector moves in and relative to the opening in a direction parallel to the fixing plate, the pin enters the second hole, the head portion is blocked by the fixing plate, and the shaft aligns with and engages in the positioning hole.

2. The fixing apparatus of claim 1, wherein the fastener further comprises a mounting member and a resilient member, the mounting member is operable to be fixed to the connector, the mounting member slidably fits about the shaft, the resilient member is connected between the mounting member and the shaft, to bias the shaft to extend out.

3. The fixing apparatus of claim 2, wherein the mounting member comprises a sleeve, and an annular end wall radially extending in from a first end of the sleeve, the shaft is extended through the sleeve and the end wall and comprises a latching portion formed on an end of the shaft opposite to the end wall, a diameter of the latching portion is greater than a diameter of the shaft, the resilient member is placed around the shaft and sandwiched between the latching portion and the end wall.

4. The fixing apparatus of claim 3, wherein the fastener further comprises an operation portion, the shaft extends from a side surface of the operation portion.

5. The fixing apparatus of claim 3, wherein a second end of the sleeve is fixed to the connector, the shaft extends through the connector.

6. The fixing apparatus of claim 5, wherein the sleeve is made of metal, and fixed to the main body by hot melting.

7. A fixing apparatus for a connector with a connecting portion, the fixing apparatus comprising:

two protrusions protrude from the connector, at either side of the connecting portion, each protrusion comprising a pin extending from the connector and a large head portion formed at a distal end of the pin;

a fixing plate defining an opening, two holes adjacent to opposite ends of the opening, and a positioning hole adjacent to one of the holes, each hole comprising a large first hole and a smaller second hole communicating with the first hole; and a fastener fixed to the connector, the fastener comprising a shaft extending out in a direction perpendicular to the fixing plate;

wherein, when the pins align with and extend through the corresponding first holes, the connecting portion extends through the opening, and the shaft abuts against the fixing plate; and when the connector moves in and relative to the opening in a direction parallel to the fixing plate, the pins enter the corresponding second holes, the head portions are blocked by the fixing plate, and the shaft aligns with and engages in the positioning hole.

8. The fixing apparatus of claim 7, wherein the fastener further comprises a mounting member and a resilient member, the mounting member is operable to be fixed to the connector, the mounting member slidably fits about the shaft, the resilient member is connected between the mounting member and the shaft, to bias the shaft to extend out.

9. The fixing apparatus of claim 8, wherein the mounting member comprises a sleeve, and an annular end wall radially extending in from a first end of the sleeve, the shaft is extended through the sleeve and the end wall and comprises a latching portion formed on an end of the shaft opposite to the end wall, a diameter of the latching portion is greater than a diameter of the shaft, the resilient member is placed around the shaft and sandwiched between the latching portion and the end wall.

10. The fixing apparatus of claim 9, wherein the fastener further comprises an operation portion, the shaft extends from a side surface of the operation portion.

11. The fixing apparatus of claim 9, wherein a second end of the sleeve is fixed to the connector, the shaft extends through the connector.

12. The fixing apparatus of claim 11, wherein the sleeve is made of metal, and fixed to the main body by hot melting.

* * * * *